United States Patent [19]

Cassidy

[11] 4,445,613

[45] May 1, 1984

[54] PROTECTIVE SHIPPING AND DISPLAY CARTON

[75] Inventor: Benjamin J. Cassidy, Waldwick, N.J.

[73] Assignee: International Paper Company, New York, N.Y.

[21] Appl. No.: 418,885

[22] Filed: Sep. 16, 1982

[51] Int. Cl.[3] ..... B65D 85/42

[52] U.S. Cl. ..... 206/418; 206/485; 206/486

[58] Field of Search ..... 206/418, 419, 420, 421, 206/422, 485, 486

[56] References Cited

U.S. PATENT DOCUMENTS

| | | | |
|---|---|---|---|
| 622,274 | 4/1899 | Schmidt . | |
| 1,281,501 | 10/1918 | Brown . | |
| 1,581,921 | 4/1926 | Doble . | |
| 1,619,608 | 3/1927 | Fairchild . | |
| 2,537,151 | 1/1951 | Mires | 229/39 |
| 2,603,401 | 7/1952 | Strauss | 229/5.5 |
| 2,643,814 | 6/1953 | Bradley | 229/37 |
| 2,676,750 | 4/1954 | Gastright | 229/39 |
| 2,866,588 | 12/1958 | Bolding | 229/39 |
| 2,884,181 | 4/1959 | McCormick | 229/41 |
| 2,918,205 | 12/1959 | Zeitter | 229/45 |
| 2,962,203 | 11/1960 | Fallert | 229/41 |
| 3,089,632 | 5/1963 | Bartolucci | 229/37 |
| 3,134,486 | 5/1964 | Voorhies | 206/418 |
| 3,181,694 | 5/1965 | Candell | 206/45.14 |
| 3,337,033 | 8/1967 | Cote | 206/45.14 |
| 3,455,498 | 7/1969 | Gadiel | 229/39 |
| 3,734,397 | 5/1973 | Cote | 229/39 B |
| 3,770,116 | 12/1973 | Cote | 206/45.14 |
| 3,941,304 | 3/1976 | Barbieri | 229/39 B |
| 4,054,203 | 10/1977 | Farquhar | 206/45.14 |
| 4,162,008 | 7/1979 | McCalmont | 206/590 |
| 4,200,192 | 4/1980 | Klomp | 206/418 |

FOREIGN PATENT DOCUMENTS

| | | |
|---|---|---|
| 181236 | 7/1954 | Austria . |
| 197455 | 4/1938 | Switzerland . |
| 209618 | 1/1924 | United Kingdom . |
| 941596 | 12/1963 | United Kingdom . |

*Primary Examiner*—Joseph Man-Fu Moy
*Attorney, Agent, or Firm*—Richard J. Ancel

[57] ABSTRACT

A paperboard container and blank therefor. The container is in the form of a tube leaving a recessed bottom closure, the closure defined by bottom-forming panels, the bottom closure having an opening frictionally engaging the threaded end of a light bulb. The container top has a plurality of inwardly folding top closure panels, each formed from a hinged pair of panels. The top closure panels exhibit; in one form of the container, a snap action when closed, to thereby further inhibit accidental opening of the top closure prior to intended removal of the light bulb. When the top closure panels are snapped inwardly and downwardly, the upper portion of the container becomes tapered, permitting it to fit into the recessed bottom of a similar container stacked thereon. The ends of top closure panels conform to the shape of the upper end of the light bulb, thus resiliently supporting it at a plurality of angularly spaced points. In another form of the container, its uppermost portion slopes upwardly, thereby facilitating nesting with a container having a similarly shaped bottom closure.

15 Claims, 8 Drawing Figures

PROTECTIVE SHIPPING AND DISPLAY CARTON

BACKGROUND OF THE INVENTION

This invention relates to a container formed of resilient sheet material such as paperboard and to a blank therefor. The invention also relates to a package for supporting and displaying an article, such as an incandescent light bulb, and especially a flood light carton.

SUMMARY OF THE INVENTION

The container and package of this invention is formed from a single blank or sheet of resilient material such as paperboard, cardboard or the like. The container is formed from a plurality of upstanding and generally rectangular main walls, with the bottom being formed by folding inwardly a bottom-forming panel, flap or tab associated with each of the main panels and integrally and foldably connected thereto. Preferably, the formed bottom is recessed. The top of the container and package is closed by means of a plurality of inwardly folding top panels. The upper portion of each of the main rectangular panels carries a pair of top cover panels, being an uppermost and lowermost top panel, with respect to the blank prior to assembly. The top panels are folded inwardly and downwardly, so that in the completed and finished container and package, a generally polygonal opening is defined, through which an article packed or carried within the container is at least partially visible. The top cover, in one final form of the container, exhibits a toggle or snap action, so that when completely closed, accidental opening of the top closures by jarring, vibration, or the like is inhibited. This toggle action is made possible by the configuration of the blank from which the container is formed, together with the natural resiliency of the sheet material, such as paperboard, from which the container and package is formed. The bottom of the container is also provided with an opening, through which one end of the article packed in the container, such as an electric light bulb, is frictionally received and held. Upon final closure of the container, the top of the container becomes tapered somewhat to thereby make possible the entry of the top of the container into the recessed bottom of a similar container stacked thereon. This facilitates the storage and display of the packages of this invention. While shown as having four sides, the number of sides may be varied within the scope of the invention. In another final form of the container, the stackability of the container with like-bottomed containers is improved.

The full nature of the invention will be understood from the accompanying drawings and the following description and claims. It should be understood, however, that reference in the following description to front, rear, side, left, right, upper and/or lower wall panels are for convenience of description, and such terms are not intended to be used in a limiting sense.

DETAILED DESCRIPTION OF THE INVENTION

Figure 1:
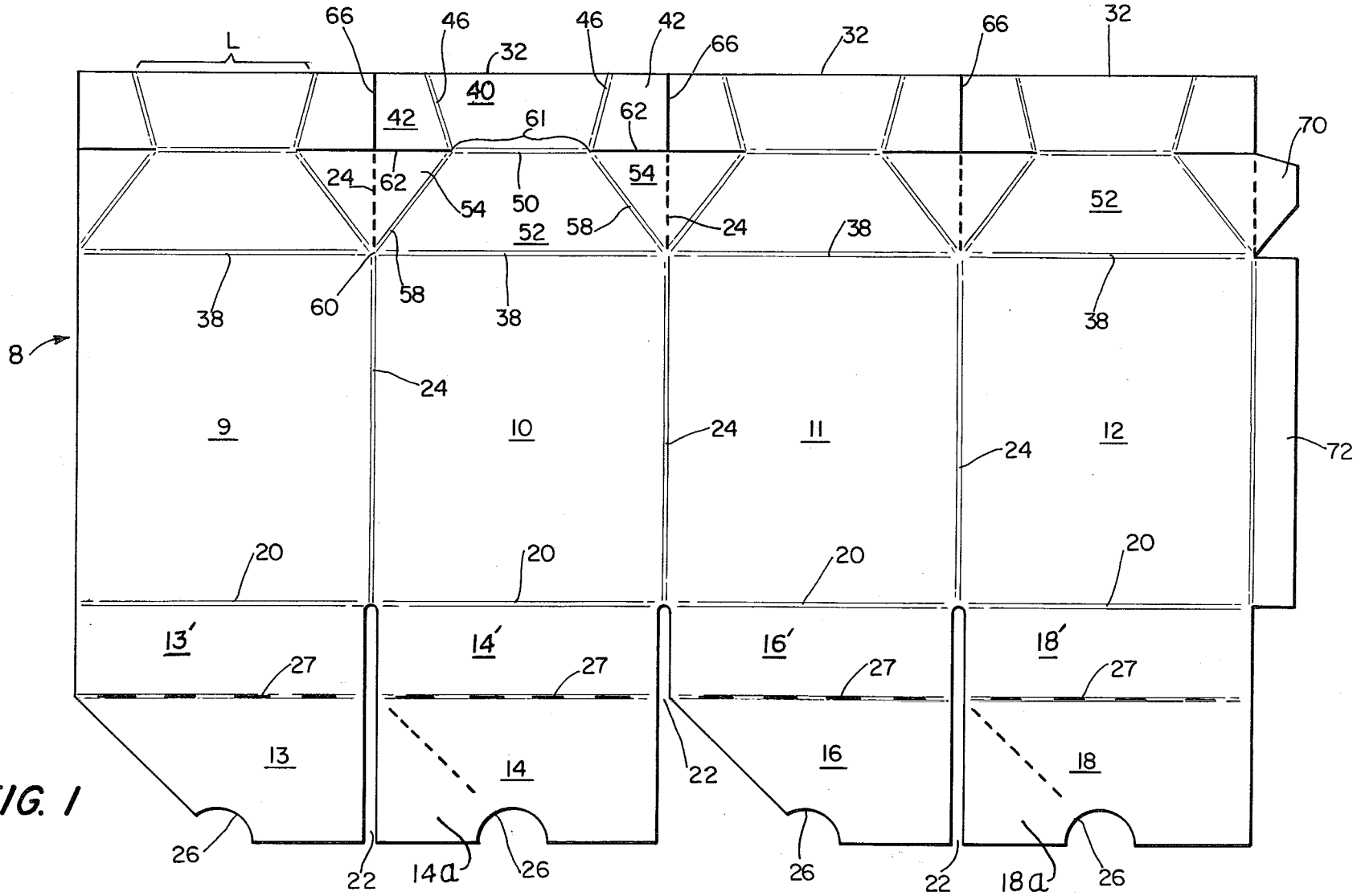
FIG. 1 is a view showing the one-piece blank from which the container of this invention is formed.

Referring now to FIG. 1 of the drawings, the numeral 8 denotes generally the one-piece blank from which the container of this invention is formed. The blank is of sheet material exhibiting a natural resiliency, such as paperboard, cardboard or the like. The numerals 9, 10, 11 and 12 denote generally rectangular main or sidewall panels. The numerals 13, 14, 16 and 18 denote bottom closure forming panels hingedly connected to their respective main sidewall panels by means of a fold line 20 extending across the lower portion of the blank. Numerals 13', 14', 16' and 18' denote the base portions, respectively, of these panels. Bottom panels 14 and 18 include triangular segments **14*a* and 18*a* respectively, defined by the dashed, slanted fold lines in these bottom panels. The numeral 22 denotes any one of three cuts between the bottom closure forming panels, cuts 22 being formed as by severing the lower portions of main fold lines 24, the latter separating the main sidewall panels 9, 10, 11 and 12 from each other. The numeral 26 denotes any one of arcuate cuts in each of the bottom closure forming panels, the arcuate cuts 26 adapted to form, when the bottom closure is formed, an opening in the bottom, as will be later described. The numeral 27 denotes a fold and score line in each bottom closure forming panel, and parallel to fold line 20 of each panel. The purpose of fold and score line 27** is to permit a recessed bottom to be formed, as will later be illustrated.

Having now described the lower portion of the blank 8, a description will now be offered of the top portion.

The numeral 32 denotes the uppermost edges of four uppermost top flaps or panels. Four top closure flaps are defined by fold line 38 at an upper portion of the blank 8, and the intersection of this fold line with main fold lines 24. In view of the identity of form of the four top closure panels (each composed of two parts), a description will be given only of one.

The numeral 40 denotes the central portion of an uppermost top closure panel, the panel 40 having free or hingable ears 42 on either side. Ears 42 pivot about fold lines 46. The numeral 50 denotes a fold line at the base of uppermost top closure panels 40, fold line 50 also being located at the upper edge of lowermost top closure panel 52. Uppermost top closure panel 42 and lowermost top closure panel 52 define the two parts of each top closure panel. The numeral 54 denotes either of two triangular ears, each ear 54 being in the form of a right triangle whose hypotenuse is defined by fold line 58. Fold lines 58 extend from the intersection of main fold lines 24 and fold lines 38 (being points 60) up to points 61, the latter being the intersection of fold line 50 with either of fold lines 46. The numeral 62 denotes a cut extending along a part of the juncture of the uppermost and the lowermost top closure panels 40 and 52, so that ears 42 pivot only about fold line 46. Triangular ears 54 of lowermost top closure panel 52, however, are each joined to the blank on two of its sides, while its third side is free because of the cuts 62.

The numeral 66 denotes cuts in the uppermost portion of main fold lines 24 to thereby separate the uppermost top closure panel 40 from each other. The length of each free uppermost edge of top closure flap 32, between the fold lines 46, is denoted by L.

For the purpose of assembling the container from the blank, the usual manufacturer's flaps 70 and 72 may be employed, these being shown at FIG. 1 as being attached to the outermost right edge portion of the blank. Thus flap 70 is foldably integral with the outermost right panel 12, more particularly integral with the lowermost top closure 52 associated therewith, while flap 72 is foldably integral along the right edge of main rectangular sidewall panel 12.

Figure 2:
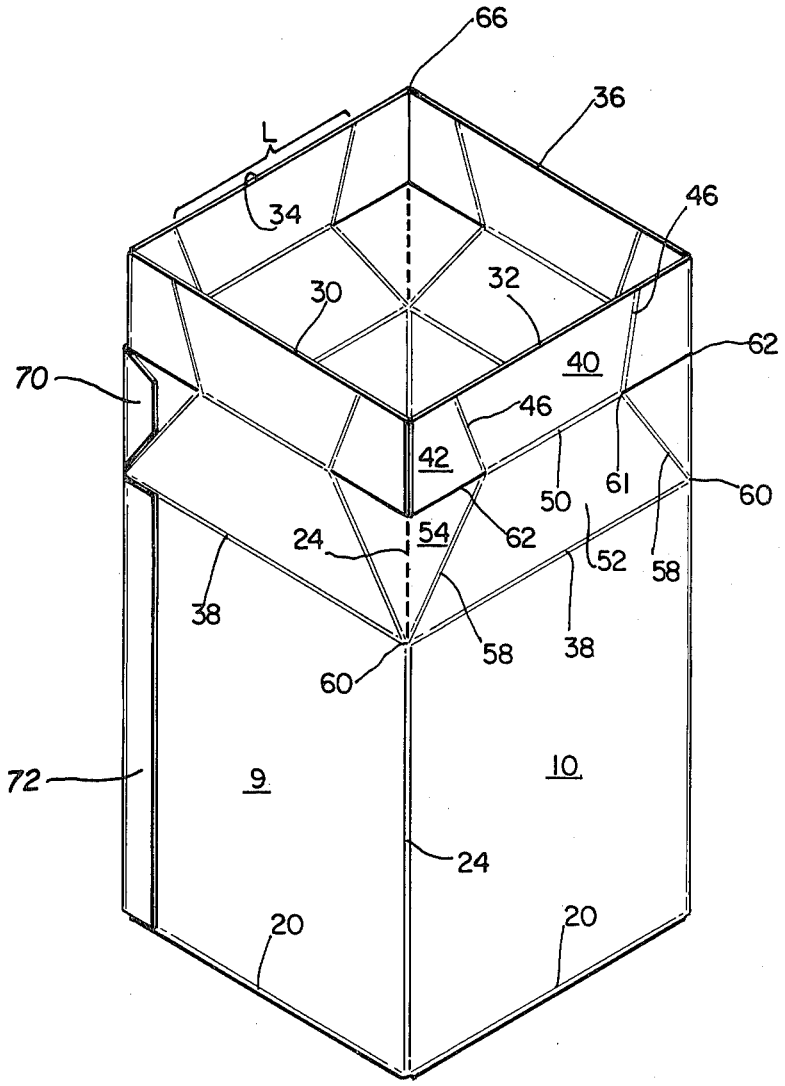
FIG. 2 is a perspective view of one stage in forming the container from the blank.

Referring now to FIG. 2 of the drawings, the reader will now visualize how the container appears during the initial stages of formation. It will be understood that the container may be formed from the blank of FIG. 1 by setting it up manually or it may possibly be done by automatic machinery, the latter forming no part of this invention.

In FIG. 2, a polygonal tube has been formed by joining the right hand edge of panel 12 to the left hand edge of panel 9 (referring to FIG. 1) by means of, for example, manufacturer's flaps such as 70 and 72.

To arrive at the configuration shown at FIG. 2, the following sequence is carried out. Glue is applied to flaps 70 and 72. Panels 13, 14, 16 and 18 are rotated 180° about score line 20, and their base portions 13', 14', 16' and 18' glued to the carton interior surface portions of their respective panels 9, 10, 11 and 12 which they overlie. Then triangular segments **14*a* and 18*a* are folded back, along the slanted dashed lines on panels 14 and 18, respectively, and onto these respective panels. Glue is placed on the outer or exposed surface of triangular segments 14*a* and 18*a***.

Lastly, side walls 9 and 12, illustrated in FIG. 1, are rotated inwardly 180° to lie flat on side walls 10 and 11 and the manufacturer's flaps 70 and 72 are glued to the edges of panel 9 which they overlie.

Figure 7:
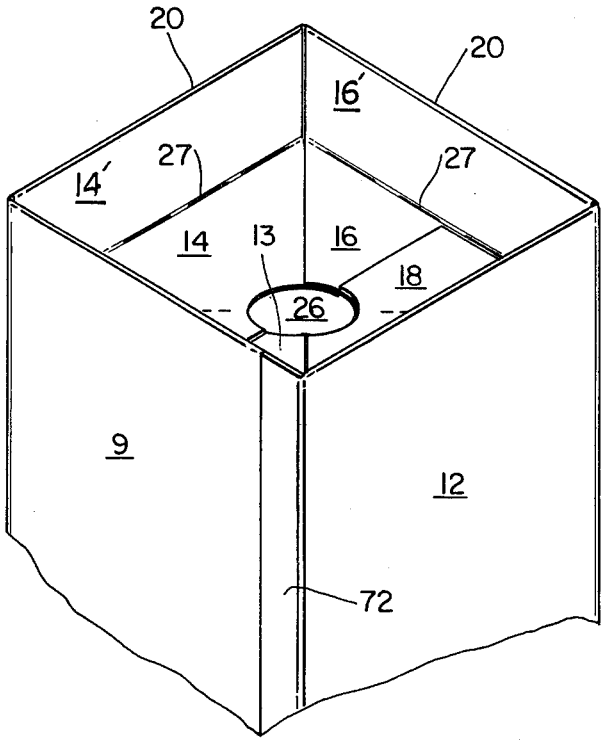
FIG. 7 is a perspective view of the bottom of the container of this invention for both FIGS. 5 and 6.

At this point, this glued blank is squared up, resulting in the carton top and side illustrated in FIG. 2 having the bottom illustrated in FIG. 7.

Figure 3:
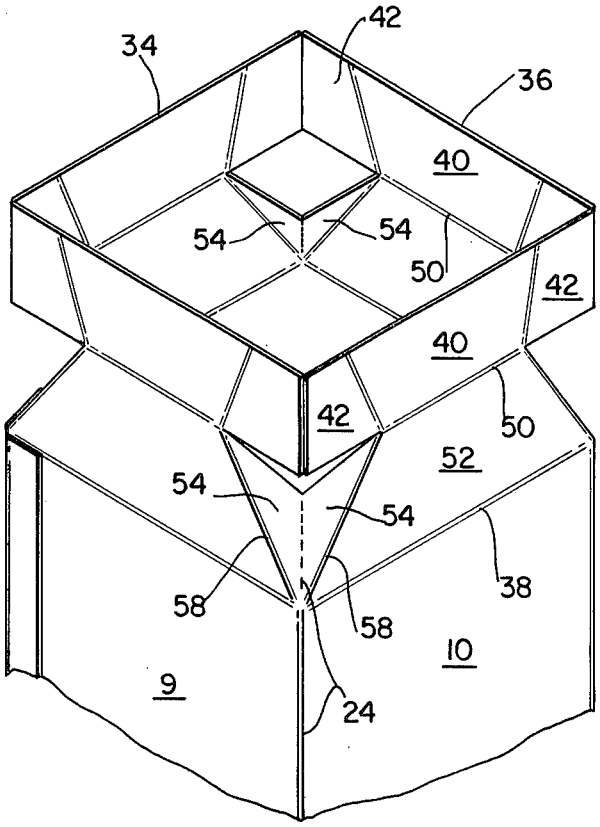
FIGS. 3 and 4 are views similar to FIG. 2, and show successive stages in the formation of the container of this invention.

Referring now to FIG. 3 of the drawings, a later step in completing the container of this invention is shown. The triangular ears 54 of each lowermost top closure 52 have been pushed inwardly at the four corners of the container, with these ears pivoting about fold lines 58 and 24.

Figure 4:
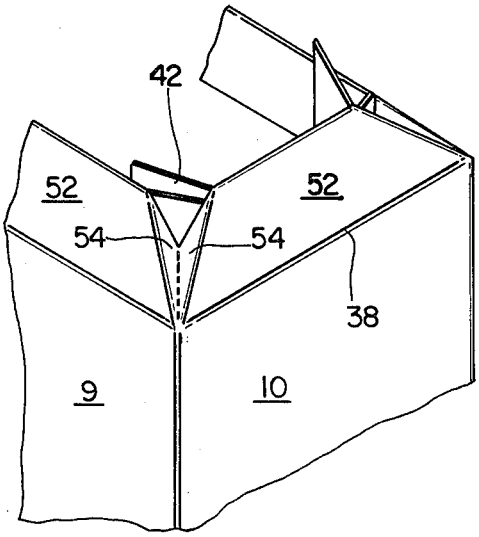

Referring now to FIG. 4, the uppermost top closure panels 40 have been folded inwardly towards the interior of the container and towards the interior surface of their respective lowermost top closure panels 52. Free ears 42 assume the position shown, i.e., somewhat overlapped but in different planes.

Figure 5:
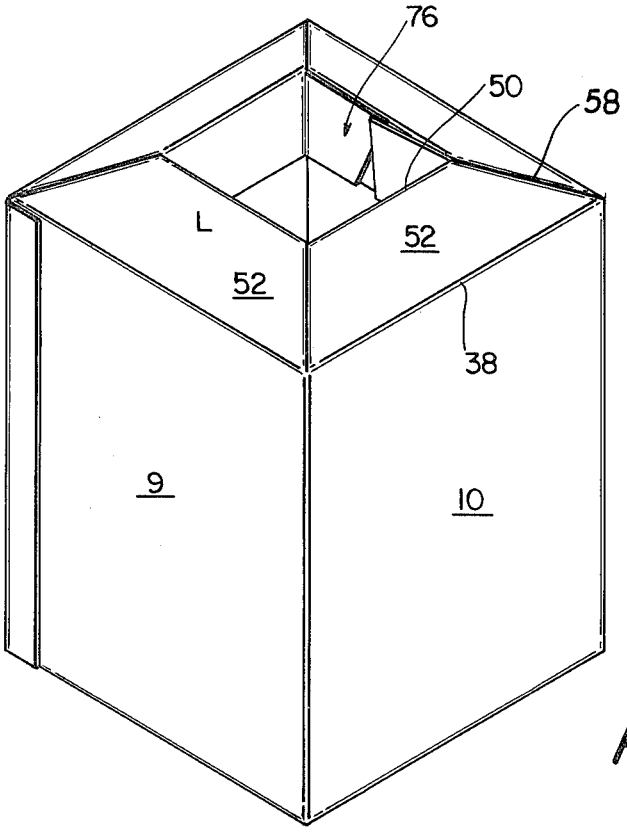
FIG. 5 is a view of the container of this invention in one of its final positions.

Referring now to FIG. 5, the inward folding of top closure panels 40 and 52 has continued until the fold lines 58 of adjacent lowermost top closure panels 52 abut each other. The hypotenuse 58 of adjacent triangular ears 54 are touching each other. At this time, a square opening 76 is formed with each side being of length L, the plane of the opening being above the plane of fold line 38. This is one form of the container as finally erected, the container adapted to hold a flood light bulb or other similarly shaped article.

At FIG. 6 another final form of the container is shown, and may be derived from the form of FIG. 5 by the inward and downward folding of top closure panels 40 and 52 so that the plane of square opening 76 is now below the level of fold line 38, i.e., below the level of the top of the container. In order to pass from the configuration of FIG. 5 to that of FIG. 6, distortion of the uppermost portion of the container must and has taken place, since in the configuration of FIG. 5, no further bending inward of panels 52 is possible without such distortion. The configuration shown at FIG. 6 thus represents a snap or toggle configuration which insures that the top closure panels can only swing upwardly and outwardly upon the purposeful application of force, as by the fingers of the ultimate purchaser of the package to gain access to the container interior.

Figure 6:
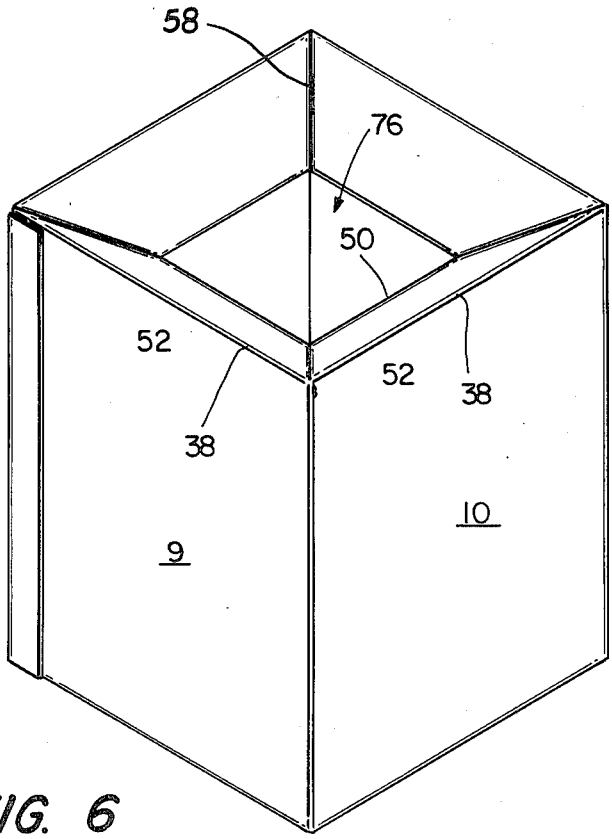
FIG. 6 is a view of the container of this invention in another of its final positions.

Referring now to FIG. 7, the final configuration of the bottom of the container of both FIGS. 5 and 6 is illustrated. Here, the bottom forming closure flaps 13, 14, 16 and 18 have been folded inwardly, about both fold lines 20 and 27, and overlap, as in the manner of an iris stop in a camera, with a round hole being formed by the mating of arcuate cuts 26. FIG. 7 illustrates forming the bottom construction as recessed, i.e., the bottom closure forming flaps are elevated or displaced upwardly from the bottom edge of the container, the bottom edge being defined by fold line 20.

Figure 8:
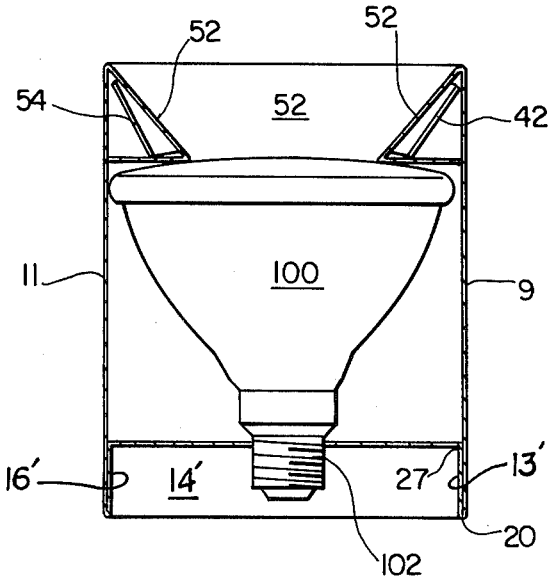
FIG. 8 is a view illustrating the container of FIG. 6 of this invention carrying a light bulb therein.

FIG. 8 illustrates the final configuration of the container illustrated in FIG. 6 with an article therein, here an electric flood light bulb 100 having the usual screw threads 102. Threads 102 are frictionally engaged by the opening in the bottom of the container, while the top portion of the light bulb is engaged and resiliently supported by free ears 42, portions of triangular ears 54 and portions of inner periphery of square opening 76. In the final container form of FIG. 5, the lower construction is the same. One method of assembling the package illustrated at FIG. 8 is first to form the bottom of the container, leaving the top open in the configuration shown at FIG. 2. Next, the light bulb 100 is inserted into the interior of the container, with its screw threads 102 being frictionally engaged by the opening having mating arcuate portions 26. The sequence of events illustrated at FIGS. 3 to 6 then takes place, thus completing the packaging of the light bulb 100 within the container. Alternatively, the sequence may be reversed. Namely, the top of the container may be formed and enclosed, the light bulb 100 then inserted, and then the bottom of the container formed around screw threads 102.

In carrying out the steps illustrated at FIGS. 2 through 6, the inward folding of the top closure panels to their position shown at the FIG. 6 configuration causes a slight tapering of the upper portion of the container. This permits the upper portion of one container to fit within the recessed bottom of an adjacent and upper container, thereby facilitating the stacking of like packages such as that shown at FIG. 8.

The carton, which is preferably formed from the blank illustrated at FIG. 1, may be made from any suitable foldable material. Preferably, it is made of paperboard or the like, having a thickness in the range of 0.020"–0.024", and suitable paperboard stock is 0.022" in thickness. The dimensions of the carton illustrated in FIG. 5 may be $4\frac{3}{4}'' \times 4\frac{3}{4}'' \times 4\frac{3}{4}''$, which are suitable for the standard 150 watt flood light, while the dimension of the inverted top carton illustrated in FIG. 6 may be $4\frac{3}{4}'' \times 4\frac{3}{4}'' \times 5\frac{3}{4}''$, which are also suitable for the standard 150 watt flood light.

Generally speaking, the present invention is directed to a one-piece blank and the container formed from the one-piece foldable and resilient blank, made, preferably, from paperboard. The container is in the form of a tube having a plurality of bottom forming panels foldably connected to the lower end of each generally rectangular panel and forming a bottom for the container, a pair of top flaps foldably connected together, respectively termed the uppermost and lowermost top flaps. The lowermost of each top flap pair is foldably connected to its respective main generally rectangular panel, and each uppermost top flap has a pair of free, foldable ears at its two sides to thereby define an uppermost free edge of length L. Each uppermost top flap is folded inwardly of the carton towards its corresponding lowermost top flap. The uppermost free edges of the uppermost top flaps form a polygonal opening at the top of the container. The opening is surrounded by downwardly sloping uppermost top flaps, and the length L of each side of the polygonal opening is such that the carton must be distorted against its natural resiliency in order to upwardly move the uppermost, downwardly sloping top panels to thereby open the top flaps and thereby gain access to the contents of the container. The top closure thus exhibits an over-center, snap closing action.

The carton of FIG. 5 is somewhat easier to stack, since the upwardly projecting panels 52 nest into the bottom recess of a superposed and stacked like-bottomed carton. The carton of FIG. 6 provides a somewhat firmer top closure. By virtue of its utility as a carton for an object in both of these configurations, the carton of this invention exhibits a duality of function.

Although the invention has been described above by reference to a preferred embodiment, it will be appreciated that other carton constructions may be devised, which are, nevertheless, within the scope and spirit of the invention and are defined by the claims appended hereto.

What is claimed is:

1. A one piece blank of foldable and resilient sheet material, such as paperboard, the blank being adapted to be folded to form a container, such as a container for a light bulb, the blank being of generally rectangular form and having a plurality of main rectangular panels, the outer two of which have free edges, the inner and remaining panels each being joined by a main fold line and being joined to each of the outer two panels by a main fold line, to thereby define a plurality of main fold lines, a lower portion of each of the main fold lines being cut to thereby define a plurality of bottom closure forming panels, an upper portion of each of main fold lines being cut to define a plurality of uppermost top closure flaps, a fold line running at right angles to the main fold lines and below the uppermost top flaps, to define a plurality of lowermost top closure flaps, the ends of the uppermost top closure flaps being cut from the adjacent lowermost top closure flaps to form free ears on the uppermost top closure flaps, a fold line on each of the two ends of each lowermost top closure flap, the lowermost top closure fold lines extending from the lowermost corners of the lowermost top closure flap to the lowermost corners of the corresponding uppermost top closure flap, whereby a carton formed from the blank exhibits a duality of final forms each of which is useful as a container.

2. The blank of claim 1 wherein each of the bottom forming panels is provided with a fold line oriented at right angles to the main fold lines and located at the same height on each main panel where the bottom forming panels are joined thereto, whereby the bottom forming flaps may be folded with respect to the main rectangular panels.

3. The blank of claim 2 including a second fold line on each bottom forming panel, parallel to the first and fold line in each bottom forming panel intermediate the top and bottom ends of each bottom forming panel, whereby a recessed bottom may be formed.

4. The blank of claim 3 wherein one lowermost corner of at least one of the bottom forming panels is provided with a slanted fold line to thereby define a triangular portion which may be folded back upon at least one bottom forming panel, to assist in forming a bottom.

5. The blank of claim 4 wherein the lowermost edge of each bottom forming panel is provided with an arcuate cut, to thereby define an aperture in the container bottom for receiving a portion of an article packed by the container.

6. A container formed from a one-piece foldable and resilient sheet material, such as paperboard, the container being in the form of tube having a plurality of generally rectangular and upstanding main outer walls, a plurality of bottom forming panels foldably connected to the lower end of each generally rectangular panel and forming a bottom for the container, a pair of top flaps foldably connected together, respectively termed the uppermost and lowermost top flaps, the lowermost of each top flap pair foldably connected to its respective main generally rectangular panel, each uppermost top flap having a pair of free, foldable ears at its two sides to thereby define an uppermost free edge, each uppermost top flap being folded inwardly of the carton and towards its corresponding lowermost top flap, the uppermost free edges of the uppermost top flaps forming a polygonal opening at the top of the container, the opening surrounded by sloping uppermost top flaps, the uppermost and lowermost top flaps forming a closure for the container.

7. The container of claim 6 wherein the ends of each lowermost top flap are foldably connected to the ends of its adjacent lowermost top flap, the ends of each lowermost top flap being folded to define a triangular ear, the hypotenuses of adjacent triangular ears touching each other, the foldable connection between the ends of adjacent lowermost top flaps extending inwardly of the container.

8. The container of claims 6 or 7 wherein the lowermost top flaps slope inwardly.

9. The container of claims 6 or 7 wherein the lowermost top flaps slope downwardly, each side of the polygonal opening being such that the carton may be distorted against the natural resiliency to move the uppermost top panels form an upward sloping configuration to a downward sloping configuration, the uppermost and lowermost top flaps forming a closure for the container and exhibiting an over-center, snap closing action.

10. The container of claims 6 or 7, wherein the container bottom is recessed, the bottom thus lying in a plane above the plane of the bottom of the main outer walls.

11. The container of claim 8 wherein the top portion of the container is inwardly tapered, whereby the top portion of one container will fit into the recessed bottom of a container stacked thereon, to thereby facilitate storage and display of a plurality of the containers.

12. The container of claims 6 or 7 wherein the ends of the bottom closure forming panels are provided with means to anchor an article packed within the container.

13. The container of claim 12 wherein the means to anchor is defined by arcuate cut-outs which form an opening, one end of the article passing through and frictionally gripped by the bottom opening.

14. The container of claim 13 wherein the article is a light bulb whose threaded end is received in the bottom opening.

15. The container of claim 7 wherein the said inwardly extending triangular ears engage and resiliently support an article packed within the container.

* * * * *